US008690699B1

(12) United States Patent
Enstad

(10) Patent No.: US 8,690,699 B1
(45) Date of Patent: Apr. 8, 2014

(54) VISUAL AID FOR GOLFING

(76) Inventor: Terrance B. Enstad, Rogers, MN (US)

( * ) Notice: Subject to any disclaimer, the term of this patent is extended or adjusted under 35 U.S.C. 154(b) by 157 days.

(21) Appl. No.: 13/373,427

(22) Filed: Nov. 14, 2011

Related U.S. Application Data

(60) Provisional application No. 61/456,943, filed on Nov. 15, 2010.

(51) Int. Cl.
*A63B 69/36* (2006.01)

(52) U.S. Cl.
USPC ..... 473/210; 473/207; 473/208

(58) Field of Classification Search
USPC ..... 473/207, 208, 210
See application file for complete search history.

(56) References Cited

U.S. PATENT DOCUMENTS 3,156,211 A * 11/1964 Mallory, Jr. ..... 473/211
3,264,002 A * 8/1966 Palumbo ..... 473/210
3,437,339 A * 4/1969 Starck ..... 473/210
4,298,201 A * 11/1981 Palinkas ..... 473/210
4,696,111 A * 9/1987 Gardner ..... 33/262
4,762,325 A * 8/1988 McCleery ..... 473/210
4,789,159 A * 12/1988 Kane ..... 473/210
5,171,152 A * 12/1992 McCleery ..... 473/210
5,253,870 A * 10/1993 Bedney ..... 473/210
D359,334 S * 6/1995 Taylor ..... D21/791
5,538,250 A * 7/1996 Putz ..... 473/210
7,997,992 B2 * 8/2011 Rim ..... 473/211
2007/0293332 A1 * 12/2007 Cranston et al. ..... 473/208

* cited by examiner

*Primary Examiner* — Raleigh W Chiu
(74) *Attorney, Agent, or Firm* — Eggink & Eggink; Anthony G. Eggink; Katrina M. Eggink

(57) ABSTRACT

A visual aid device to provide a reference line for a golfer. The device has an elongated linear member held by opposing clips adapted for securement to the bill of a golf cap. The elongated member may be a stretchable elastic member or a rigid member to provide a reference line for a putter or wedge, for example, as the golfer addresses and strikes the golf ball. Spaced markings may further be utilized to provide additional visual aids to a golfer and advertising or logos may be applied to the clip members.

15 Claims, 5 Drawing Sheets

VISUAL AID FOR GOLFING

This application claims the benefit of U.S. Provisional Application Ser. No. 61/456,943, filed Nov. 15, 2010.

BACKGROUND OF THE INVENTION

The present invention relates generally to a visual aid for golfing. Particularly, the present invention relates to a visual aid device to align a golf club with a golf ball for putting and chipping. More particularly, the invention relates to a visual aid adapted for securement to headwear, such as to a visor or bill of a golf cap, for example. The visual aid provides a reference line for aligning a putter or an iron to the golf ball to aid a golfer from club back swing to club follow through.

Golfers have long sought practice and teaching aids in the game of golf, particularly, in the short distances to the green and in putting. Although the importance of keeping the eye on the ball and maintaining a still body and head when striking a golf ball are well known, the actual practice of repeatedly doing so is difficult.

The visual aid of the present invention provides an easy to use, versatile and economical means for a golfer to properly position the body, to address the ball and to pull back, strike the ball and to follow through with the club movement. The visual aid may be used by left and right handed golfers and may be adapted to be easily connected to the bill of a golf cap.

The device may be used in connection with any headwear of a golfer, such as a cap, hat, visor or headband having an outwardly extending member such as a bill, brim, or visor, for example. The device may also be incorporated into a headgear assembly to provide a unitary structure.

SUMMARY OF THE INVENTION

A visual aid device for attachment to the bill of a golf cap to provide a reference line between the eyes of the golfer and the golf ball position in front of the golfer's feet.

The visual aid device is comprised of an elongated member having a specified length and which may have any desired color to provide contrast or aesthetics. Clip members are provided for connecting the elongated member to the headgear of the golfer. A cover may be provided to envelop the connection point between the clip and the elongated member. The clip members, such as alligator clips, are adapted to be secured to the bill or visor of a golf cap, for example, so as to position the elongated member downwardly from and below the bill and in alignment with the eyes of the golfer.

The elongated member may be an adjustable rigid member or a stretchable elastic member. The rigid elongated member may be adjustably held by loops extending from the clip members whereas the elastic member may be directly connected to the respective clip members. The elongated member may have spaced markings to provide distance references to further aid the golfer with proper club drawback. The visual aid device may also utilize an extension member which may be secured to the elastic member so as to provide a longer reference line for club drawback, ball striking and club follow through. The visual aid device of the invention may also have logos or printed matter thereon to identify a golf course, a golfing related product, a sponsor, a specified golfing event, or any other mark of an advertiser.

The visual aid device of the invention may have structure as discussed above, to be attached to and removed from headwear, such as a golf cap, for example, or the visual aid may be incorporated into a headgear assembly.

A benefit of the present invention is to provide a visual aid device or assembly for golfers, which is economical, easy to use and effective for aligning a golf club to a golf ball. Another benefit of the present invention is to provide a reference line spatially from and in alignment across the eyes of a golfer. It is yet another benefit of the present invention to provide a visual aid device having an elongated member which is easily adjustable for use to accommodate right and left handed golfers.

These and other benefits of this invention will become clear from the following description by reference to the drawings.

DESCRIPTION OF THE PREFERRED EMBODIMENTS

Figure 1:
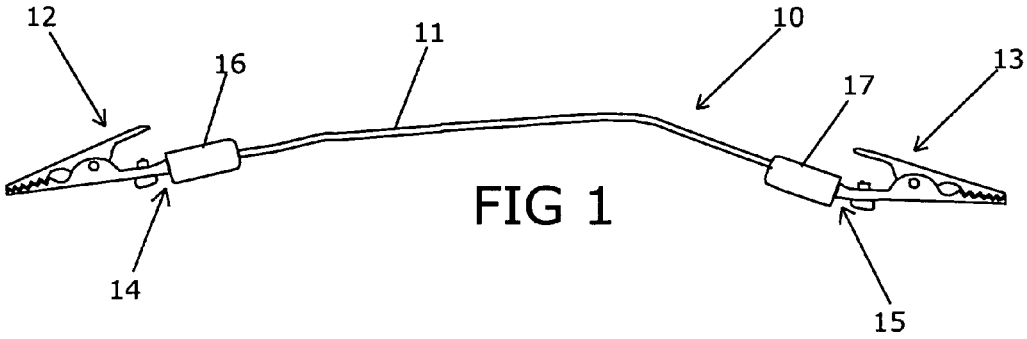
FIG. 1 is a top plan view showing the visual aid device of the present invention.

The present invention shown in the drawings disclose visual aid devices and assemblies for use by golfers to align a golf club to a golf ball. The visual aids utilize an elongated member which may be rigid or elastic for attachment to headgear of the golfer to thereby provide a reference line between the eyes of the golfer and the golf ball and golf club.

Referring to FIG. 1, the visual aid device 10 of the present invention is shown having an elongated elastic member 11 with clips 12 and 13 attached at the opposing terminal ends of the elastic member 11. The terminal end connections 14 and 15 are shown being covered by tubular covers 16 and 17. The terminal connections may be made by a crimping portion of the clips or by a similar connection.

Figure 2:
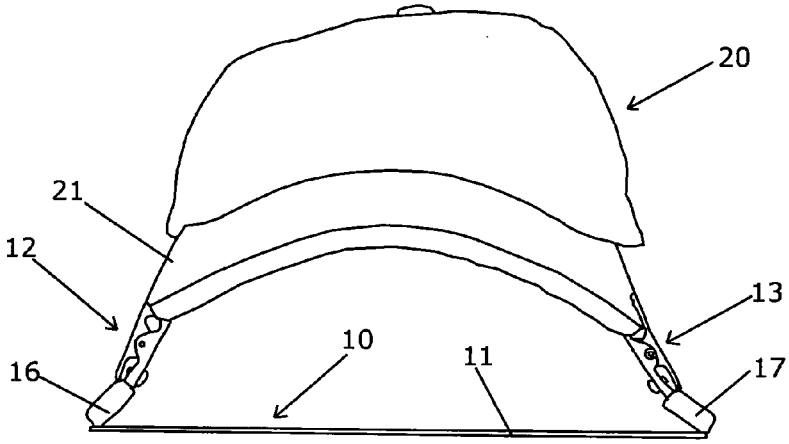
FIG. 2 is a frontal view of a golf cap and showing the visual aid device of FIG. 1 attached to the bill of the golf cap.
Figure 3:
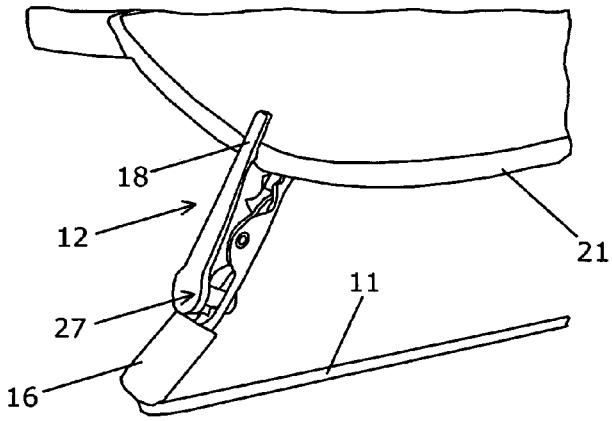
FIG. 3 is a close-up view showing the attachment of the clip member of the visual aid device attached to the bill of the golf cap.

In FIG. 2, the visual aid device 10 is shown attached to the bill or visor 21 of a golf cap 20. As shown, the elastic member 11 is in a stretched configuration so as to form a straight line positioned downwardly from bill 21 due to the positioning of clips 12 and 13. In FIG. 3, clip 12 is shown to be an alligator clip having teeth 18 engaging the edge of bill 21. The end portion of clip 12 may be provided with a logo 27 or other identifying marking. Elastic member 11 is shown spaced downwardly from bill 21, for example, by 1-3 inches, so that the reference line provided by elastic member 11 is properly aligned with a golfer's eyes.

The tubular members 16, 17 which may be rigid or semi-rigid members cover the terminal connections of elastic member 11 to the respective clips 12, 13 and may also provide for the appropriate spacing of the elastic member 11 from the cap bill.

Figure 4:
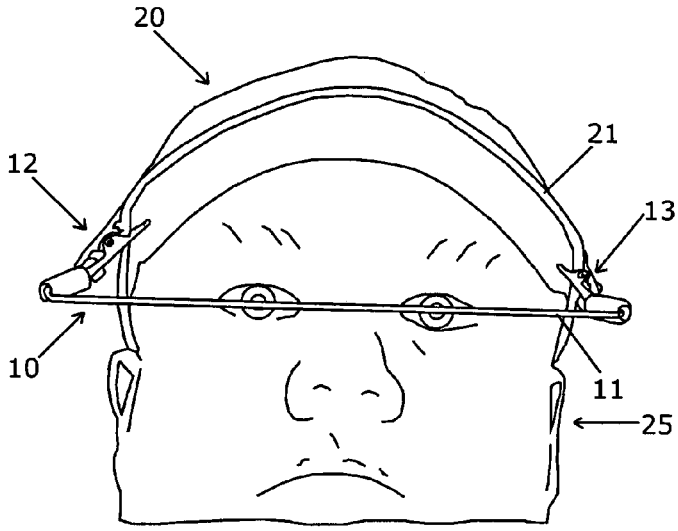
FIG. 4 is a frontal view of a golfer showing the reference line formed by the visual aid device with respect to the golfer's eyes.
Figure 5:
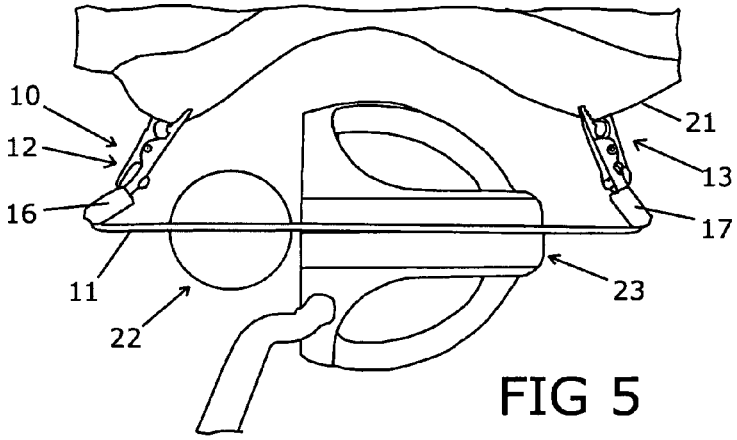
FIG. 5 is a top view showing the reference line formed by the visual aid device with respect to a golf ball and the head of a putter.
Figure 6:
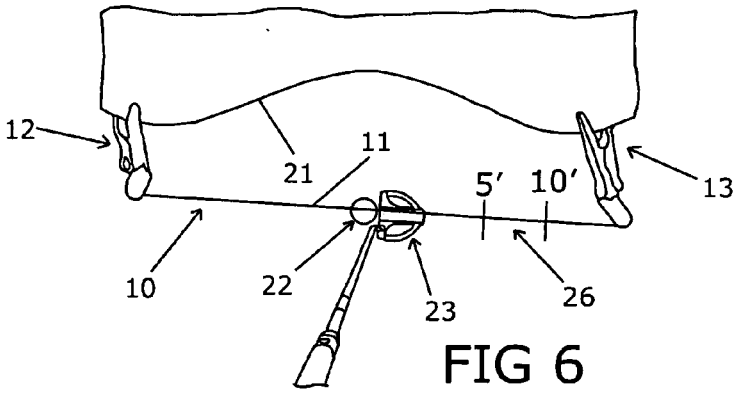
FIG. 6 is a top view of the golf ball and putter of FIG. 5 as seen by a golfer and further showing distance markings on the stretched elastic member of the visual aid device.

In FIG. 4, the stretched elastic member 11 is shown providing a straight line spatially across and with respect to the eyes of golfer 25. Clips 12 are shown positioning stretched elastic member 11 downwardly from bill 21 so that elastic member 11 is aligned with respect to the eyes of a golfer 25. In FIGS. 5 and 6 a golf ball 22 and a putter head 23 are shown positioned in alignment with the stretched elastic member 11. To provide a reference for a back swing for putter head 23, markings 26 may be provided on member 11, i.e., circumferential lines about the periphery of member 11 to designate a distance of 5 feet or 10 feet, for example, thereby providing the golfer with a distance for pulling back the putter head for example. The visual aid device 10 or Putting Line™ aid allows the golfer to pull back a putter using the reference line as a guide to set the golf ball in generally the middle of the line, keep the head still and follow through the line to the hole.

Figure 7:
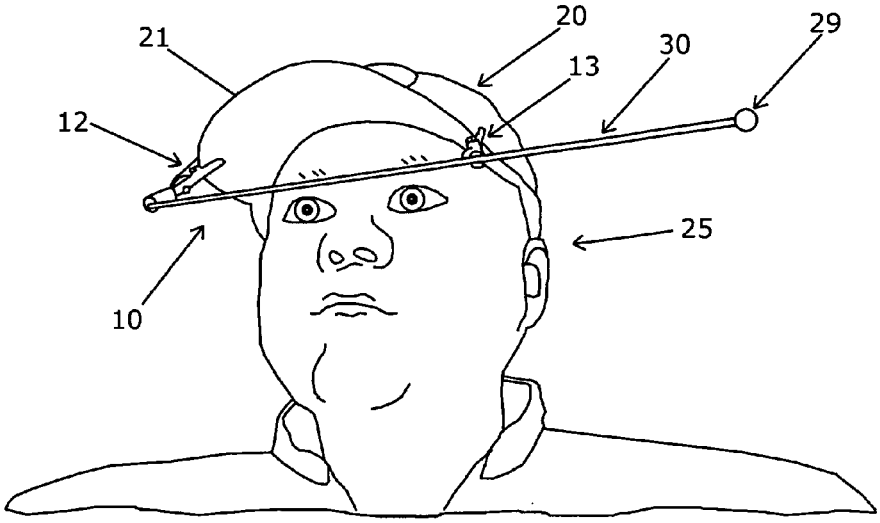
FIG. 7 is a perspective view showing a golfer utilizing the visual aid device of the invention and further showing an extension member protruding from and in alignment with the stretched elastic member of the visual aid device.
Figure 8:
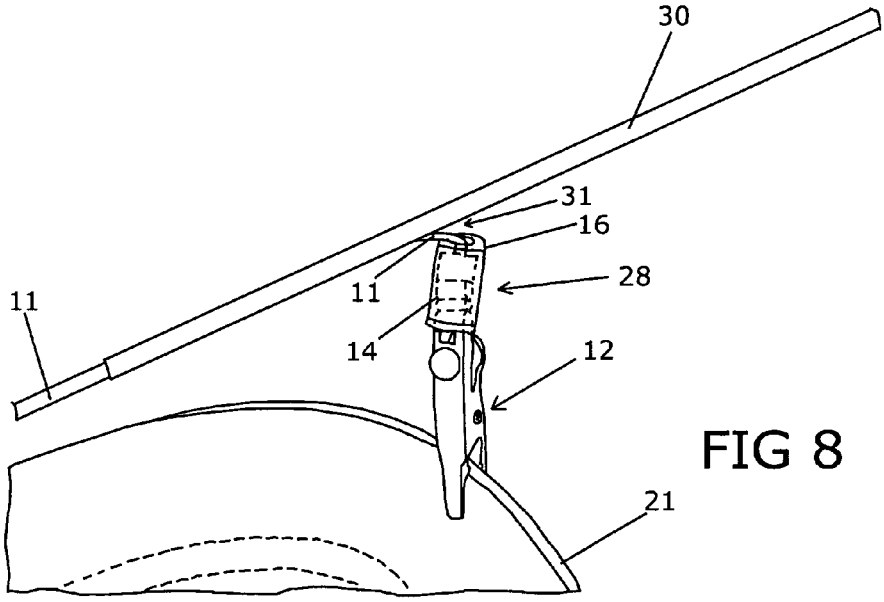
FIG. 8 is a close-up view showing the extension member of FIG. 7 and further showing a logo on a cover member of the visual aid device.

Referring to FIGS. 7 and 8, an extension member 30 is shown attached to elastic member 11. The extension member 30 may extend outwardly from the reference line provided by the stretched elastic member 11 so as to provide a longer reference line for club follow through, for example. As shown a ball 29, such as a small, foam golf ball may be mounted to the end of the extension member 30 so as to provide a reference point for putting the golf ball into the hole.

Figure 9:
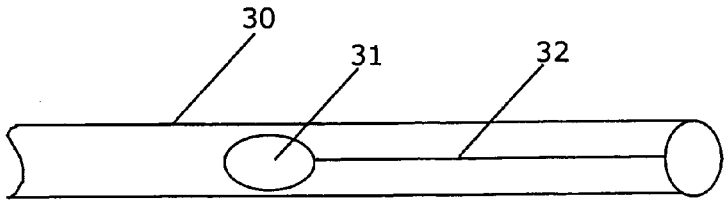
FIG. 9 is a close-up view of the extension member showing means to connect the extension member to the stretched elastic member of the visual aid device.

As shown in FIG. 9, the extension member 30 may be a tubular structure having a slit 32 which extends from the end of the tubular member 30 to an aperture or cutout portion 31. The latter configuration allowing the tubular member to be mounted to the stretched elastic member 11 and wherein the cutout 31 provides for the entry of the elastic member 11 at the connection between the clip and member 11. The extension member 30 may be constructed of a plastic tubular member constructed to allow separation and spring back at slit 31. It is within the purview of the invention to utilize other known means to attach the extension member to the elongated linear member or the elastic member 11 of the visual aid device 10.

In FIGS. 3 and 8, logos 27 and 28 are shown positioned on clip 12 and which may be provided to designate a specific golf course, a golf club, event sponsor, golfing event or the logo of any desired advertiser.

The elastic member 11 may be formed of polymeric material having elastic properties such as a bungee-type cord structure, nylon, a rubber composition or the like. A covering for the stretchable elastic member permits easy coloring for the visual aid device.

Figure 10:
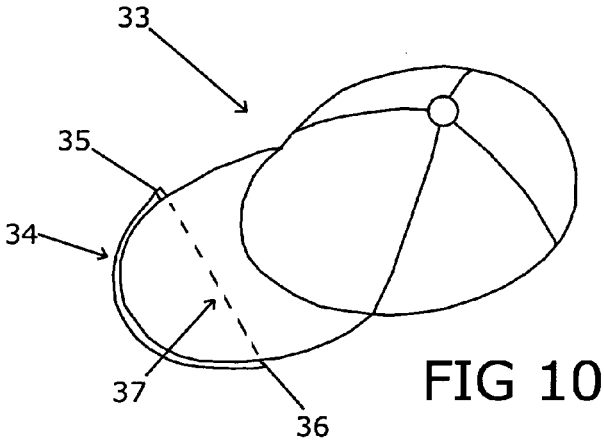
FIG. 10 is a perspective view showing another embodiment of the visual aid device mounted to the bill of a golf cap.

The visual aid device 10 shown in the drawings and discussed above is one embodiment of the invention for providing a reference line for a golfer utilizing headwear such as a golf cap, for example. Other embodiments utilizing the device and incorporating it into a golf cap to provide specialized head gear, are also within the purview of the invention. For example, as shown in FIG. 10 the device 10 without clips 12, 13 may be attached at points 35 and 36 and incorporated in a stretched configuration to the bill edge of a cap 33. When desired, the elastic member 34 may be removed from the bill edge so as to align across the bottom of the bill and in alignment with the eyes of the golfer as shown by line 37.

Figure 11:
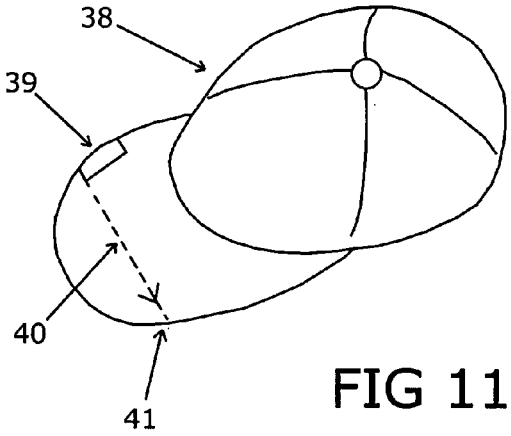
FIG. 11 is a perspective view showing another embodiment of the visual aid device stored in or to the bill of a golf cap.

As further shown in FIG. 11, the elastic member 40 may be attached at one end onto the bottom of a cap bill of cap 38 and connectable to the opposite side of the bill at point 41. For example, a length of stretchable, elastic material 40 may be stored within the bill at storage position 39 and accessible for stretching across and for attachment to the opposite side of the cap bill at 41. The rigid members 15, 16 may be provided to hold elastic member 40 or other elongated linear member downwardly from the cap bill. Although the headgear shown in FIGS. 10 and 11 utilize a cap, other headwear, such as a visor, for example, may also be utilized. The thrust of the present invention is to provide a visual aid for golfing comprising a reference line spatially from and in alignment across the eyes of a golfer.

Figure 12:
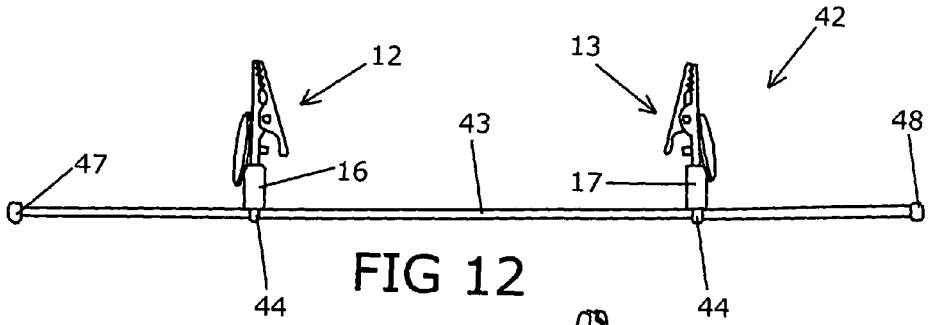
FIG. 12 is a top view of another embodiment of the visual aid device of the invention.
Figure 13:
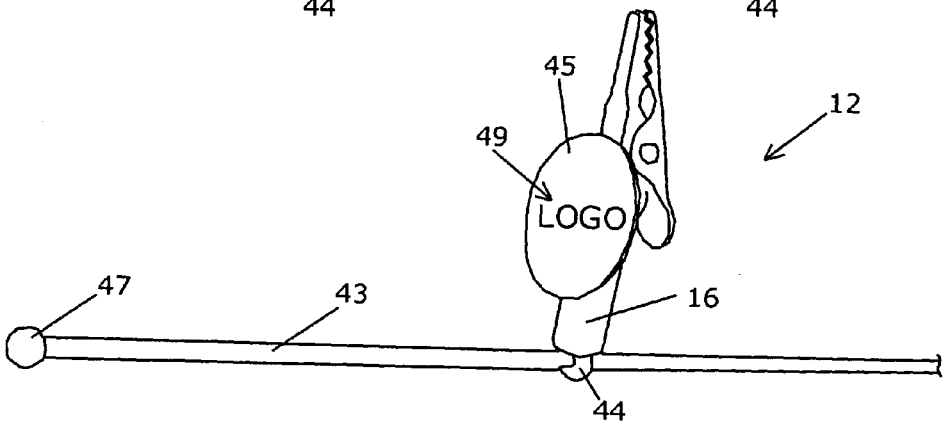
FIG. 13 is a perspective view showing one end portion of the visual aid device of FIG. 12.
Figure 14:
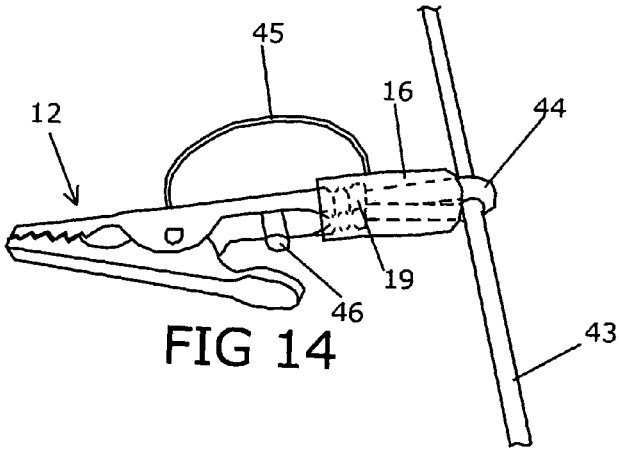
FIG. 14 is another perspective view of the clip member of FIG. 13.

Another embodiment of the invention is shown in FIGS. 12-14 wherein the visual aid device 42 comprises a pair of clips 12, 13 each having a loop of elastic material 44 attached to the attachment portion 19 (i.e., via crimping) of the clip members 12, 13. The loop member 44 may be an elastic member having a length of approximately one inch. The connection is shown covered by cover sleeves 16, 17. An elongated member 43 is shown slidably held by the loops 44 thereby allowing the elongated member 43 to be moved left or right depending upon the preference of the golfer, i.e., right or left handed golfer for example. The elongated member 43 may be approximately 12 inches in length, 3/32 inches in diameter and constructed of a rigid material such as a light weight tubular metal or plastic, for example. The elongated member 43 is shown having enlarged terminal portions 47, 48 which are small rounded portions having a diameter of approximately ¼ inches, for example. The enlarged terminal portions 47, 48 allow the elongated member 43 to be easily slid from left to right between loops 44 of clips 12, 13 without dislodgment of the elongated member 43 and so as to provide the desired extension beyond either clip 12 or 13 depending upon the golfer's preference, i.e., whether left or right handed. When fully extended in either direction the elongated terminal portions abut the loops 44. Each clip 12, 13 is shown having a rounded member 45 which may have advertising or a logo 49. The rounded member 45 may be a removable ball marker held to the clip either by pin 46 in an aperture of the clip or magnetically to the clip. For example, the golf ball marker 45 may be constructed of a metallic structure or other material having a metallic or magnetic characteristic. Alternatively a magnetic member may be coupled to the clip member 12, 13.

In summary, the elongated elastic member 11 allows the device 10 to be utilized on a variety of sized caps and cap bills. The elongated linear member may be elastic or rigid and formed of compositions known in the art. The elongated member is preferably thin such as having a diameter of approximately 1/16 or 3/32 inch, for example. The clip member 12, 13 discussed above, provides an easy and effective means to attach and remove the device 10 or 42 from the outward projection of the golfer's headwear. The clip members provide a dual function for the device, namely, device attachment and providing the downward spacing of the elongated linear member from the cap bill, for example. Other means of attachment and spacing elements may be utilized within the purview of the invention. An alligator clip, for example, have a length of approximately 2 inches, which when attached may provide a 1.5-1.25 inch spacing from the cap bill peripheral edge.

As many changes are possible to the visual aid for golfing embodiments of this invention utilizing the teachings thereof, the descriptions above, and the accompanying drawing should be interpreted in the illustrative and not in the limited sense.

That which is claimed is:

1. A visual aid device to provide a reference line for aligning a club to a golf ball comprising:

a) an elongated member of a specified length and having opposing terminal ends, said elongated member being an elastic member and having at least one marking visible around the periphery of said member to designate a specified distance for pulling back a golf club; and b) a pair of clip members, each having a means to hold said elongated member, said clip members being adapted for gripping the outward projection of headwear, whereby said elongated member provides a visual reference line, downwardly from the outward projection of the headwear and in alignment with the eyes of a golfer.

2. The visual aid device of claim 1, wherein said clip members are alligator clips and wherein said means to hold said elongated member is a loop to slidably hold said elongated member.

3. The visual aid device of claim 1, wherein said clip members have a logo or other marking to identify a golf course or golfing event.

4. The visual aid device of claim 1, wherein each said clip member is provided with a tubular cover member to cover the connection of the means to hold said elongated member and wherein said cover member has a specified color.

5. The visual aid device of claim 1, wherein an extension member is provided for attachment to said elastic member and wherein said extension member is a tubular structure having an elongated slot for receiving said elastic member.

6. The visual aid device of claim 1, wherein said outward projection of headwear comprises the bill of a golf cap.

7. A visual aid assembly for golfers comprising:

a) headgear having a projecting front portion for extending outward from the forehead of a golfer;

b) an elongated linear member having terminal ends, said elongated linear member being an elastic member;

c) means to hold said elongated linear member to said projecting front portion of said headgear, whereby said elongated linear member is spatially positioned from and in alignment with the eyes of the golfer; and d) an extension member for attachment to said elongated linear member, said extension member extending in alignment with said elongated linear member and outward at least one said terminal end of said elongated linear member, said elongated linear member further having at least one marking thereon.

8. The visual aid assembly for golfers of claim 7, wherein said headgear includes headwear selected from the group consisting of a hat, visor, cap and headband.

9. The visual aid assembly for golfers of claim 7, wherein said means to hold said elongated member comprises a pair of clip members for attachment to said elongated linear member and wherein said clip members are removably attached to said projecting front portion of said head gear.

10. The visual aid assembly for golfers of claim 9, wherein each clip member has a loop member.

11. The visual aid assembly for golfers of claim 7, wherein said elongated linear member has a predetermined color and wherein said visual aid assembly has a logo or printed matter thereon.

12. A visual aid device attachable to the projecting front portion of headwear of a golfer to provide a reference line for aligning a club to a golf ball comprising:

a) an elongated linear member having terminal ends;

b) means to attach said elongated linear member to the projecting front portion of the headwear spatially from and in alignment with the eyes of the golfer, whereby said elongated linear member provides a reference for the eyes of the golfer to align the golf club with the golf ball; and c) an extension member for attachment to said elongated linear member, said extension member extending in alignment with said elongated linear member and outward at least one said terminal end of said elongated linear member, said elongated linear member further having at least one marking thereon.

13. The visual aid device of claim 12, wherein said elongated linear member is elastic or rigid and wherein said means to attach said terminal ends of said elongated linear member comprises clips.

14. The visual aid device of claim 13, wherein said elongated member is rigid and adjustably attached to said clips.

15. The visual aid device of claim 14, wherein said means to attach comprises a loop member extending from each said clips.

* * * * *